United States Patent [19]

Desert et al.

[11] 4,434,692

[45] Mar. 6, 1984

[54] GRID-TYPE BREAD-SLICING MACHINE

[76] Inventors: Jean-Marie G. Desert, Rue des Chataigniers 32, B 4480 Oupeye; Franciskus J. Walrave, Rue Lieutenant Albert Dressen 6, B 4860 Pepinster, both of Belgium

[21] Appl. No.: 271,697

[22] Filed: Jun. 8, 1981

[30] Foreign Application Priority Data

Jun. 6, 1980 [DE] Fed. Rep. of Germany ..... 3021284

[51] Int. Cl.[3] ..... B26D 1/11

[52] U.S. Cl. ..... 83/62; 83/72; 83/403.1; 83/425.3; 83/427; 83/435.1

[58] Field of Search ..... 83/72, 74, 75, 751, 83/425.3, 427, 403.1, 734, 62, 435.1

[56] References Cited

U.S. PATENT DOCUMENTS

| | | | |
|---|---|---|---|
| 2,000,816 | 5/1935 | Bettendorf et al. | 83/751 X |
| 2,162,138 | 6/1939 | Tuthill et al. | 83/751 X |
| 2,762,402 | 9/1956 | Smith | 83/403.1 |
| 3,592,094 | 7/1971 | Greenblatt | 83/72 |
| 3,789,279 | 1/1974 | Dempsy | 83/72 |
| 3,960,041 | 6/1976 | Warren et al. | 83/435.1 X |

FOREIGN PATENT DOCUMENTS 2157161 2/1974 Fed. Rep. of Germany .

*Primary Examiner*—James M. Meister

*Attorney, Agent, or Firm*—Lloyd L. Zickert

[57] ABSTRACT

A bread slicing machine comprises a grid (20) of vertically set blades (22) which are reciprocated longitudinally by an oscillator (29) driven by an electric motor (M2). Bread to be sliced is fed to the grid (20) by a horizontally reciprocable table (13) which is moved by a chain-drive system (16) driven by an electric motor (M1). The rate of feed of the loaf carriage (13) is controlled automatically according to the cutting effort required by means of a current limiting element (61) in the electrical supply circuit for motor (M1). Additionally, a temperature limit switch (60) acting as an interrupter is connected to the power supply of motor (M1) and is arranged so that during current limiting operation of element (61) the interrupter (60) is operable to disconnect the power supply to motor (M1) in the event of the monitored temperature exceeding a preset level. The power supply to the motor (M1) is adjustable in value by means of a manually operable regulator (57) whereby the maximum rate of feed of the loaf carriage can be preset.

7 Claims, 3 Drawing Figures

GRID-TYPE BREAD-SLICING MACHINE

The present invention relates to a grid-type bread-slicing machine, with drive motors for the knife grid and for a chain drive system operating the load carriage, the rate of feed of said load carriage being controlled automatically according to the cutting effort required at the particular point in the bread.

In such bread-slicing machines, a constantly running motor is employed and a friction coupling is incorporated in the gear system for the loaf carriage (see DE-AS No. 2,157,161). The torque of the friction coupling is adjustable, which is intended to enable the feed power to adjust to the particular consistency of the various kinds of bread encountered. This method of controlling the rate of feed is not satisfactory in all cases. Adjustment of the torque to be applied cannot be effected sufficiently accurately and is largely dependent upon the particular type of coupling elements employed, which leads to uncontrollable variations. Moreover, such a friction coupling requires a special space allocation in the bread-slicing machine, which is thus no longer available to accommodate other important components.

The object of the invention is to develop a grid-type bread-slicing machine of the kind stated above and having a loaf carriage which can be adjusted to deal individually with the particular consistency of the various kinds of bread.

According to the present invention there is provided a grid-type bread-slicing machine comprising a chain-driven loaf carriage and a knife grid each driven by a drive motor wherein the rate of feed of said loaf carriage is controlled automatically according to the cutting effort required by the knife grid at any particular cutting point in the bread, characterised in that the drive motor for the loaf carriage chain drive system is provided with a current-limiting element for its power requirement, the purpose of which is to reduce progressively the rotary speed of the drive motor as the power requirement increases as a result of increasing resistance to the loaf carrage during the slicing operation.

The level of current limitation is firstly selected so that normal variations in consistency of the bread do not influence the feed system immediately, and a certain loss in efficiency of the machine occurs. In such cases, the knife grid is capable of producing an excellent cutting pattern in the bread. If however the bread is of the hard type, the power requirement of the drive motor finally increases to such an extent that the current reaches the value determined by the limit element. If the resistance to the forward cutting effort increases further, the drive motor cannot obtain further power which it would otherwise require to maintain the rate of feed. This is reflected in a reduction of rotary speed. This produces automatic control of the feed which adapts itself very closely to the power requirement of the motor. This is an accurate measure of the consistency of the bread to be sliced. Having dispensed with the component normally employed, space is now available within the gearing for the loaf carriage, which can now be utilised for other purposes. The current-limiting element according to the invention can be conveniently integrated into the electrical equipment of the machine and, since it is electronic, occupies very little space.

With this arrangement, according to the invention, the loaf carriage advance can also be interrupted if an object, which might damage the machine or knife grid, should reach the slicing point. The only consideration is the time during which the current-limiting element is operative or the extent of the fall in rotary speed of the motor, which is deducible from the power requirement of the drive motor. In the power supply to the motor an interrupter is located whih responds to this. In its simplest form, this interrupter is a limit temperature switch which cuts the power supply to the drive motor when the temperature rises to a certain point. In the meantime, the drive of the knife grid may continue to operate.

In addition, the normal rotary speed of the drive motor should in the first place be variable to suit the particular kind of bread to be sliced, so that the most suitable slicing speed is obtained in each case. For this purpose, the simplest means is adjustment of the power supply to the drive motor of the chain drive, which can be obtained by regulating the terminal voltage of the motor.

For automatic operation of the machine, at least one limit switch is preferably provided in respect of both of the bread input side and also of the slice-removal side, each said switch co-operating with the loaf carriage and being responsible for changing the drive direction of the motor from forward to reverse and vice versa, and also possibly for controlling the rotary speed of the motor. On pressing a starter button, the machine then proceeds to operate automatically. It is even possible to provide several limit switches at the loaf-input side, of which only one at a time becomes operative and each of which is located at a different distance from the knife grid. In this way, the loaf carriage requires to be reversed only that distance which is necessary for inserting a loaf of a given dimension. With broad types of loaf, the limit switch is located further away than in the case of narrow loaves. The efficiency of the machine is thus better utilised.

The drive motor is preferably provided with a change-over switch which, in one switch position, provides for a continuous cyclic repetition of the forward and reverse motions of the loaf carriage, so that the machine can operate automatically. In this case, loaves can be supplied continuously at the input side by means of a chute or the like without the necessity of a new starting pulse for each loaf.

The various manual controls are preferably grouped together. If these are accommodated on a casing above the knife grid, they are thus easily accessible from all sides of the machine. It is thus no longer necessary for the operator to be at a special position at the machine in order to operate the manual controls.

An embodiment of the invention is illustrated by way of example in the drawings, in which.

Figure 1:
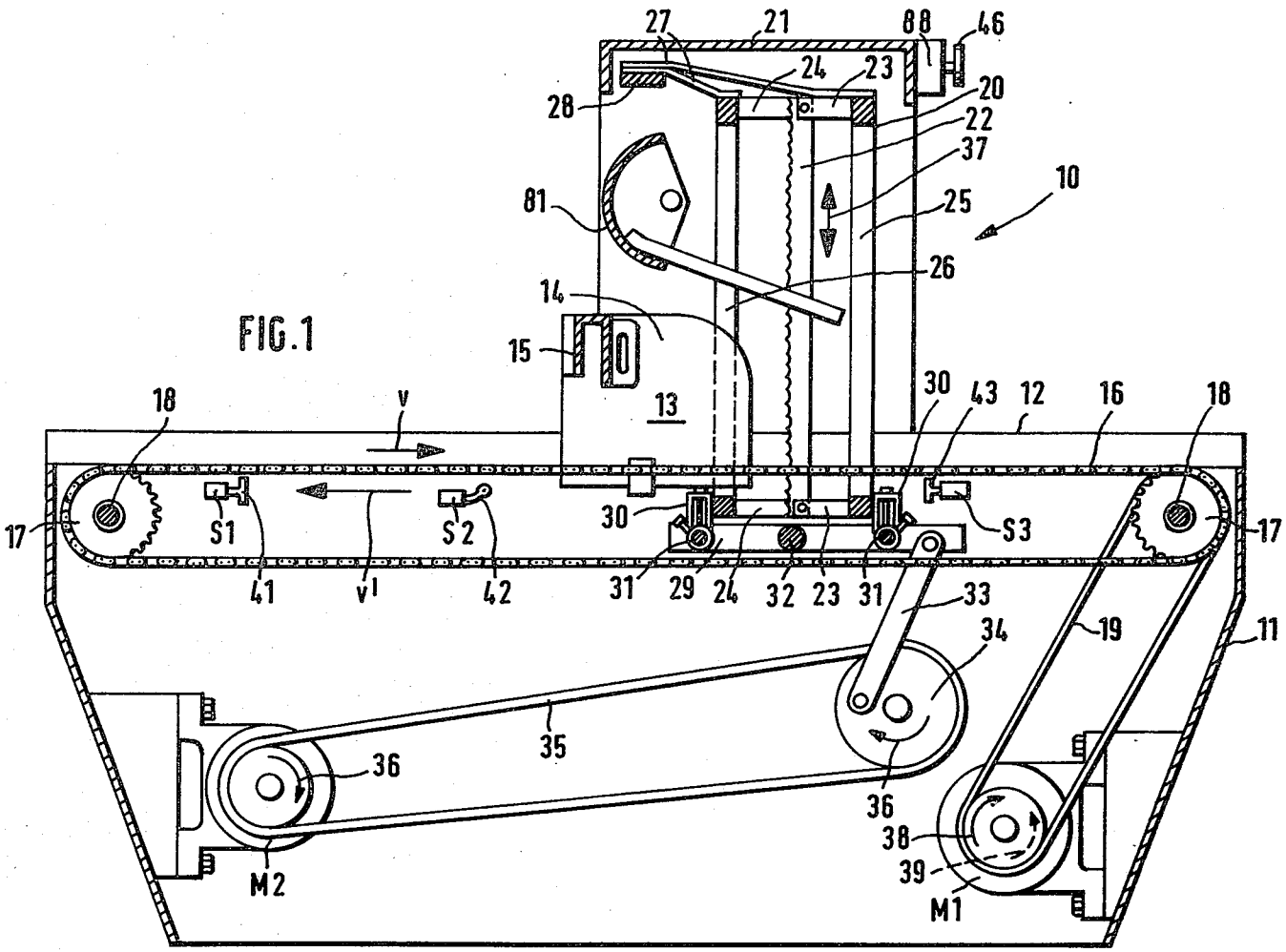
FIG. 1 is a sectional elevation view of a grid-type bread-slicing machine according to the invention.
Figure 2:
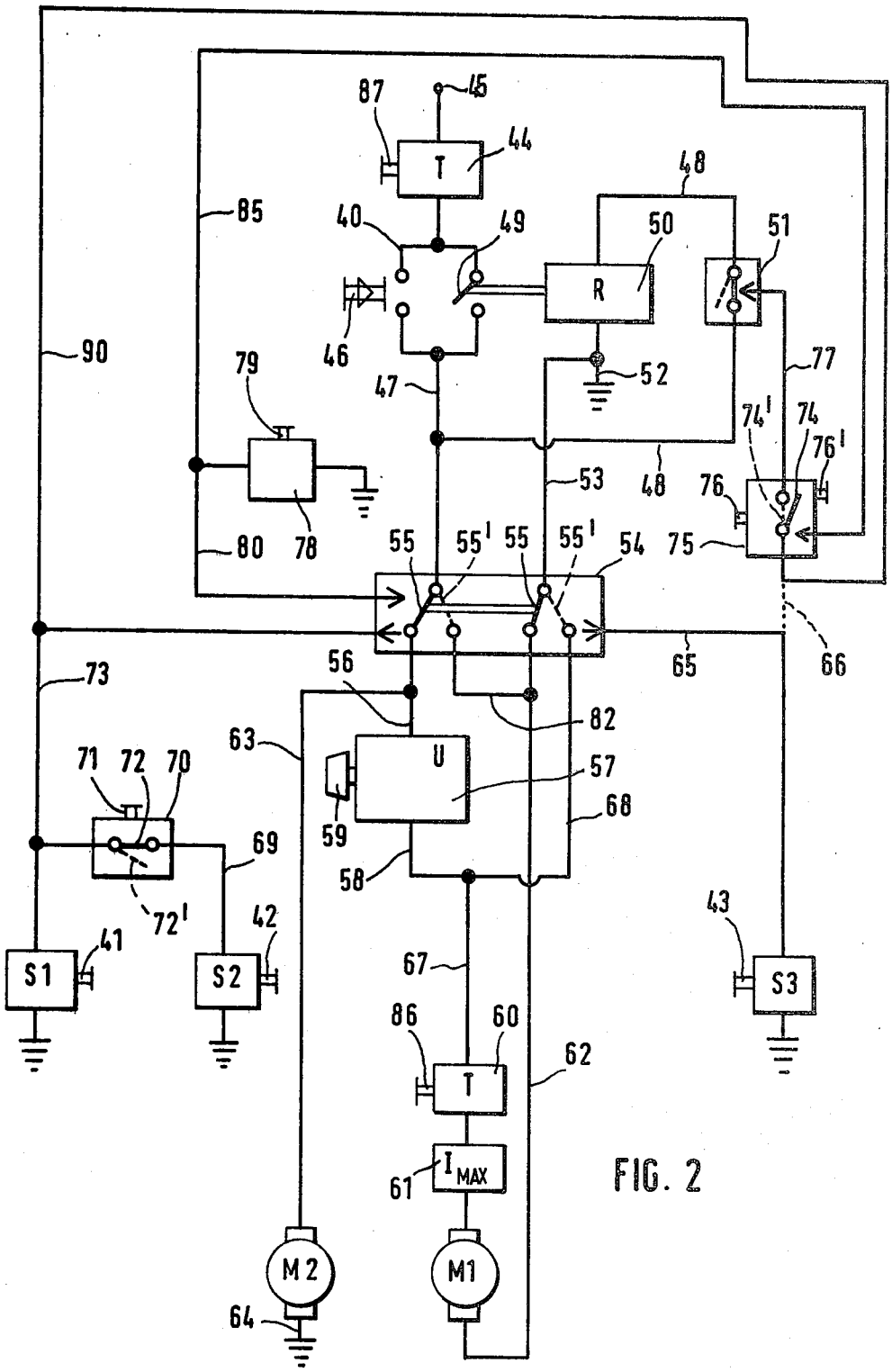
FIG. 2 is a circuit diagram for the machine of FIG. 1.

The bread slicing machine 10 comprises a table housing 11 in which the electrical control system shown in FIG. 2 is accommodated, together with the mechanical drive means which can be seen in FIG. 1. Above the table surface 12 is erected a grid of knives 20 which is enclosed on both sides and also above in a casing 21.

The knife grid 20 comprises a plurality of vertically set knives 22 in spaced relationship to each other corresponding to the desired thickness of slice. The knifes 22 are all arranged in a row but their upper and lower extremities are attached alternately to one of two frames 25, 26 by holders 23, 24. The upper extremities of the two frames 25, 26 are mounted by means of flexible linkages 27 fitted to a cross-piece 28, so that they can move in parallel direction, whilst their lower extremities are pivotally mounted on oppositely disposed arms of a pair of oscillators 29. For this purpose, adjustable securing means 30 are provided, by means of which the lower extremities of the frames 25, 26 are attached to pivotal shafts 31, each extending between the two oscillators 29. The oscillators 29 are mounted on a shaft 32 extending between opposite lateral walls of the table housing 11. One extremity of the oscillators 29 is connected by a crank arm 33 to a crank disc 34 which is caused to rotate in the direction shown by the arrow 36 in the drawing by a motor M2, employing a belt 35.

As the motor M2 rotates, as shown at 36, the ends of the oscillator 29 are moved alternately upwards and downwards, the two frames 25 and 26 following exactly the same vertical motion. At the same time, the knives 22 connected to each of these perform a reciprocating motion in opposite direction to each other as shown at 37 (FIG. 1).

A loaf carriage 13 is employed to convey the material to be sliced to the knives 22 at the correct speed. The carriage 13 is of comb-like construction and is provided with a plurality of blades 14 which are interconnected by a bar 15 and are arranged at a suitable distance apart from each other so that each is situated opposite one of the gaps between the knives 22. The loaf carriage 13 is connected to a chain drive 16 which passes as an endless ring around chain wheels 17 mounted on shafts 18 in the front and rear portion of the table housing 11. One of the shafts 18 is driven by a belt 19 from a drive motor M1 so that it rotates alternately in two different directions. As the motor M1 rotates in the direction 38, the loaf carriage 13 is conveyed by the chain drive 16 at a certain rate of feed v towards the knives 22. The motor M1 can rotate however at a higher speed 39 in the opposite direction, so that the loaf carriage is moved at a higher speed v' in the reverse direction. For switching the motor M1 from one direction of rotation to the other 38, 39, various limit switches S1, S2, S3 are provided in the table housing 11, the relevant actuating members thereof 41, 42, 43 being arranged to project into the path of motion of the loaf carriage 13. As the loaf carriage 13 comes into contact with one or other of these actuating members, the direction of rotation 38, 39 of the drive motor M1 is reversed or the motor is switched off. The details of these operations may be seen in the circuit diagram of FIG. 2.

The circuit diagram shows firstly, a starter switch 40. This switch is connected by way of a limit temperature switch 44 to a current supply 45. The control 46 of the starter switch 40 is in the form of a press-key. When it is pressed, a relay 50 is activated through the leads 47, 48 connected thereto and closes the permanent contact 49 in the starter switch 40 so that the apparatus remains switched on as long as there is voltage at the relay 50. This remains so when the contact shown in an interrupter 51 is closed, said interrupter lying in the current supply circuit 48 to the relay 50. In the present case, direct current is employed. By way of the lead 53, one pole of a two-pole change-over switch 54 is connected to an earth lead 52, e.g. of the relay 50, whilst the aforementioned lead 47 of the starter switch 40 is connected to the other pole thereof.

The two movable contacts of the two-pole change-over switch 54 are coupled together so that they have a common action. In this way, they can assume either the position 55 indicated in full lines, or the alternative position 55' shown dotted, between the four output terminals in the change-over switch 54. In the position 55, the current is firstly conveyed via one contact to a lead 56 to which a voltage regulator 57 is connected, the output voltage of which can be adjusted at the lead 58 by means of a manual control 59. The aforementioned drive motor M1 for the chain drive 16 shown in FIG. 1, is connected to the lead 58 by way of a limit temperature switch 60 and a current limiter 61. By adjusting the voltage in the regulator 57 with the control 59, the rotation 38 of the motor M1 can be altered so that the rate of feed v can be regulated to suit the particular type of loaf contained in the loaf carriage 13. The control 59 can be preset to the various types of bread commonly required so that the correct adjustment can be easily made. From the motor M1 the current is connected via the lead 62 and the other contact member of the change-over switch 54 to the aforementioned earth lead 53. The motor M1 is a D.C. motor.

The motor M2 for the knife grid 20 is actually an A.C. motor with separate current supply. It is controlled by a further contact (not shown) in the change-over switch 54, but this is shown simplified in FIG. 2. The motor M2 is supplied here with current via a lead 63 connected to the lead 56 and is provided with an ground 64. The aforementioned voltage regulator 57 does not affect the motor M2, so that the knife grid 20 is always driven by the motor at a constant speed 36.

When the loaf carriage comes into contact with the actuating member 43 of the limit switch S3 shown in FIGS. 1 and 2, a control pulse is conveyed via the leads 65, 66 to the change-over switch 54, which brings the movable contacts into the position 55', shown dotted. Now the polarity of the drive motor M1 for the chain drive 16 is reversed, so that it rotates in the opposite direction 39, shown in FIG. 1. This is due to the fact that current is supplied from the current supply 47 via the switched contact 55' and by way of the leads 82, 62 to the motor M1. From here, the current passes to the current limiter 61 and limit temperature switch 60 along the leads 67, 68 to the other pole, where the other switched contact 55' completes the connection with the ground lead 52. The current does not pass through the voltage regulator 57, so that a higher voltage exists at the motor M1 than in the case of the forward feed, thus producing the aforementioned higher reversing speed v' of the loaf carriage 13. Reversing occurs until the aforementioned actuating members 42 or 41 of the switches S2 or S1 become effective when the loaf carriage 13 strikes against them. The switches S1, S2 are arranged at a distance from the knife grid 20 corresponding to the varying widths of two kinds of loaf. According to which of these kinds of loaf is about to be sliced, the control 71 of a switch 70 is used which is mounted in a lead 69 between the two switches S1, S2. In the contact position 72 shown in full lines in FIG. 2, the switch S2 is in operation which is intended for a narrow type of loaf. If the contact member of the switch 70 is in the position 72' shown dotted, the switch S2 is inoperative and the switch S1 is in operation, which is the case when a broader type of loaf is involved.

If more than two different widths of loaf are involved, it is manifest that a correspondingly greater number of switches S1, S2, etc. may be provided which are situated in the machine at suitable distances relative to the knife grid 20. Irrespective of which of the switches S1 or S2 is engaged, the same procedure occurs when the loaf carriage 13 comes into contact with the relevant actuating member 41 or 42. A switch pulse is conveyed via the lead 73 to the chang-over switch 54, which brings the contact members from the position 55' back to the position 55, whereby the motion v' of the loaf carriage 13 is again changed to the direction of feed v already described. In this respect, the machine has automatic operation. Between the switch S3 on the output side for slice-removal and one of the switches S1 or S2 on the input side of the machine, the loaf carriage 13 is caused automatically to operate alternately to-and-fro from forward feed to reverse. At the change-over points of its reversing motion, the loaf carriage 13 may pause for a certain time and this can be effected by the use of suitable switch delay elements which in the present case might conceivably be integrated into the switches S1, S2, S3. Where such automatic operation is employed, a new loaf to be sliced can be automatically positioned before the loaf carriage 13 at the input side, which loaf is placed on the table 12 of the machine, for example laterally by means of a conveyor or from above by means of a chute, at the moment when the carriage has reached that reversing point of its motion.

This automatic system of operation is provided when the movable contact member 74 of a switch 75 occupies the switch position shown in FIG. 2. This switch position 74 is obtained when a manual control 76 of the switch 75 is operated, which now prevents the control pulse from the switch S1 or S2 from reaching the lead 77 situated behind the switch 75. The switch 75 is in the "automatic operation" position, the manner of operation of which was described above in detail.

The switch 75 is provided however with a further control 76' which returns the contact member thereof to the position 74' shown dotted in FIG. 2. Instead of providing a special manual control 76', a single control could be provided which, with one operation places the contact member in the position 74 and, with another operation, places it in the position 74'.

When the contact member of the switch 75 is in the position 74', the machine is set for "single operation". The control pulse from the switch S1 or S2 then passes along the lead 90, is passed by the switch 75 to the lead 77, and causes a temporary opening of the aforementioned switch 51. The contact of the switch 51 is then moved briefly from the closed position shown in full lines to the open position shown dotted. The current flow is thus interrupted by the relay 50. The aforementioned permanent contact 49 is then moved to the off-position shown in FIG. 2, whereby the current supply to motor M1 and also to motor M2 is interrupted. The machine is then at rest. In this case, the machine comes to a halt when the loaf carriage 13 has completed the full reverse movement v'. The loaf carriage 13 is then in the position to receive a loaf at the input side. To slice a new loaf, the control 46 of the starter switch 40 is again operated, which begins a new work-cycle. After its completion, this work-cycle stops automatically when the switch 75 is placed in the aforementioned "single operation" position.

Interruption of the current supply in the switch S1 for the relay 50, instead of occurring at the limit switch S1 or S2 on the input side of the machine, might similarly be effected from the switch S3 at the output side. Instead of the lead 90, all that is required is to connect the switch 75 to the limit switch S3 by the connection 66 shown dotted. The loaf carriage 13 then comes to rest at the end of the forward feed v in the area of the knife grid.

The machine is also provided however with an emergency switch 78, the manual control 79 of which immediately halts the forward feed v of the loaf carriage 13. In this case, the contact member 55 of the change-over switch 54 is immediately placed in the reverse position 55' by way of the lead 80, whereby, as has already been described, the rotation of the motor M1 is reversed to the direction 39, so that the motion of the loaf carriage 13 is reversed to v'. The knives 22 in the grid 20 are thus released from the forward pressure of the loaf carriage 13, so that the possibility of a serious accident is avoided. A pivotable upper pressure arm 81 for the loaf is provided in the knife grid. The emergency switch 78 also conveys a cut-out pulse via a lead 85 to the aforementioned automatic switch 75, which ensures that, in case the contact member in the switch position 74 is set for automatic operation, a change to the switch position 74' for "single operation" is in fact made. Operation is then halted in any case at the end of the reverse motion when the loaf carriage 13 has reached its reversing point at the input side of the machine. At this moment, as was already explained above, the switches S1 and S2 at the input side are connected by the lead 90 to the input side of the switch 75. By operating these switches S1 or S2, the aforementioned interrupter 51 of the current supply for the relay 50 is switched off. The switch 40 at the input is then changed to its off-position. The motors M1 and M2 are at rest.

During reversing v' of the loaf carriage 13, for purposes of greater safety and for economy of energy, the motor M2 for the knife grid 20 should preferably be automatically switched off, not indicated in the circuit diagram of FIG. 2.

Figure 3:
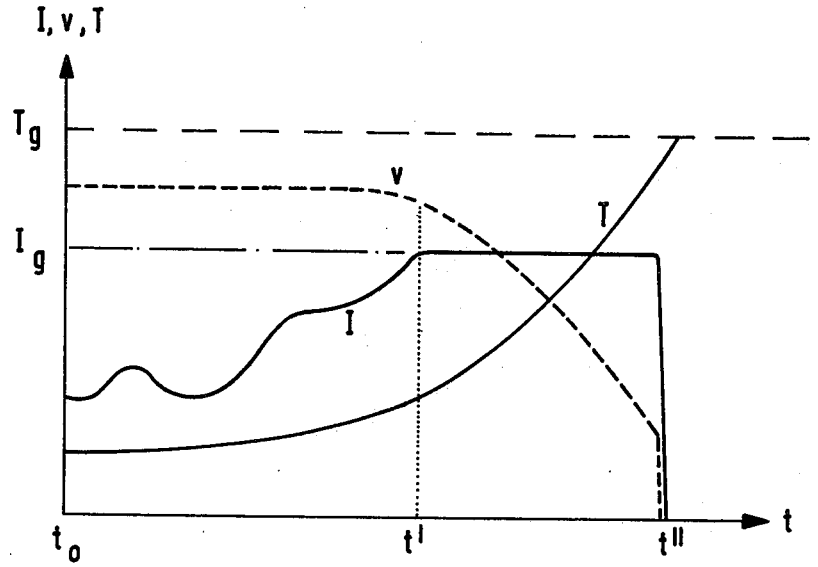
FIG. 3 shows, in each case over the time axis, the curve for the current of the drive motor of the chain drive, for the speed of the loaf-carriage advance, and the temperature in the case of automatic means for switching off the machine.

The special purpose of the current limiter 61 is made clear with reference to FIG. 3. The current limiter 61 allows an increase in current in the motor M1 only as far as the value Ig shown in FIG. 3. In the time period to-t', shown on the horizontal time axis in FIG. 3, current fluctuations may occur which are caused during slicing of the bread crust by a varying power requirement in the motor M1 and which do not need to occasion any alteration in the rate of feed v, as shown by the dotted curve in FIG. 3. Then, however, as shown in the case of FIG. 3, a hard piece of bread reaches the slicing point of the knives 22, which requires an increase in current supply to the motor M1. The current would require to rise above the limit value Ig. This occurs at the point of time t' in FIG. 3. The current limiter 61 does not however permit this, so that the rate of feed v begins to fall progressively as the power requirement of the motor increases. The rate of feed v drops considerably, as is seen from the dotted curve beyond the point of time t'. At the same time, the temperature also increases, as shown by the full-line curve T in FIG. 3, and this is monitored at the limit temperature switch 60. The limit temperature is shown dotted at Tg in FIG. 3. This temperature is so determined that, in the case of a moderate fall in feed rate v, the switch 60 does not respond. This applies to the period t'-t''. Finally, however, the forward feed action has become so laborious that, due to the increase in power requirement, the temperature reaches the predetermined limit value Tg. The current supply to the motor M1 is then interrupted by the limit temperature switch 60, which, in the case in question in FIG. 3, occurs at the point of time t''. At this moment the current is interrupted at t'', as shown by the course of the curve I, whereupon the rate of feed v also returns to zero. The motor M1 comes to a halt, whilst the motor M2, which is unaffected thereby, continues to operate.

When the defect has been remedied, the motor M1 can be set in motion once more by operating manually a starter control 86 at the limit temperature switch 60. The machine can now resume normal operation. Operation can continue at a constant rate of feed v, provided that the power requirement does not reach the aforementioned limit value Ig. If this limit value is exceeded, however, the drive speed v is adjusted automatically to the correct lower value, as was shown during the period t''-t' in the example of FIG. 3 where there was increasing difficulty with the slicing quality of the bread. Thus, the machine according to the invention adjusts automatically to the correct rate of feed v where the manual control 59 at the voltage regulator 57 was inadvertently set for the incorrect type of bread. The machine thus corrects itself automatically by electrical means.

In the case of the above embodiment, the increase in requirement in the current supply to the motor M1 was monitored, so that its rate of feed v was correspondingly reduced. Instead of this arrangement, it might also be possible to monitor the current consumption in the supply lead 63 to the motor M2 for the movement 37 of the knife grid 20 if the effort involved in slicing that particular kind of bread could be better determined thereby. Such a monitor element could then influence the speed control of the motor M1 and, when it had fallen to a lower limit value or when a limit temperature was exceeded, finally halt the motor completely.

Cases are also conceivable in which serious difficulties occur which might also necessitate switching off the motor M2 for the motion 37 of the knife grid 20. For this purpose, it is sufficient to provide a further limit temperature switch 44 in the general current supply 45 for both motors M1 and M2, which eventually responds under these extreme conditions and interrupts the current supply. In this case, both motors M1, M2 are halted. When the defect has been remedied, a suitable starter control 87 is employed to switch on the limit temperature switch 44 again, whereupon normal operation of the motors M1, M2 is resumed.

Finally, as shown in FIG. 1, it would also be possible to accommodate all important actuating members 46, 79, 76 or 76' in a common switch-box 88 which is easily accessible on the upper part of the aforementioned casing 21. These controls might also include the control 59 for the voltage regulator 57. If desired, the aforementioned starter controls 86, 87 of the limit temperature switches 60, 44 could also be located at the same place, so that all operating controls would then be easily accessible from all sides at the upper part of the machine.

What is claimed is:

1. A grid-type bread-slicing machine comprising a chain-driven loaf carriage and a knife grid each driven by an electric drive motor, wherein the rate of feed of said loaf carriage is controlled automatically by a control system for the drive motor thereof according to the cutting effort required by the knife grid at any particular cutting point in the bread, there being no movement between the carriage and the bread during cutting thereof, characterised in that the electrical supply circuit for the drive motor for the loaf carriage chain drive system includes a solid state current-limiting element for its power requirement which limits the current to the drive motor and progressively reduces the rotary speed thereof as the power requirement increases as a result of increasing resistance to the loaf carriage during the slicing operation, and an interruptor, said interruptor being responsive when said current limiting element is operative to reduce the speed of said drive motor.

2. A machine according to claim 1, wherein the interrupter is a limit temperature switch.

3. A machine according to claim 1, wherein the power supply to said drive motor of the chain drive is adjustable by a terminal voltage regulator.

4. A machine according to claim 1, wherein at least one limit switch is provided for the loaf carriage in respect both of the bread input side and also of the slice-removal side, each said switch co-operating with the loaf carriage and being responsible for changing the drive direction of the loaf carriage drive motor from forward to reverse and vice versa.

5. A machine according to claim 1, wherein at the bread input side, a plurality of equivalent limit switches is provided for the loaf carriage and which are located at certain distances from the knife grid and of which only one at a time becomes operative according to the particular operation on hand.

6. A grid-type bread-slicing machine comprising a chain-driven loaf carriage and a knife grid each driven by a drive motor, wherein the rate of feed of said loaf carriage is controlled automatically by a control system for the drive motor thereof according to the cutting effort required by the knife grid at any particular cutting point in the bread, characterised in that the drive motor for the loaf carriage chain drive system is provided with a current-limiting element for its power requirement, the purpose of which is to reduce progressively the rotary speed of the drive motor as the power requirement increases as a result of increasing resistance to the loaf carriage during the slicing operation, and said control system for the loaf carriage drive motor includes a change-over switch, one position of which produces a continuous cyclic repetition of the forward and reverse motions of the loaf carriage, while the other switch position operates the forward and reverse motions only once.

7. A machine according to claim 6, wherein manual controls provided for the switch and for operation of the machine are accommodated on a casing above the knife grid.

* * * * *